United States Patent [19]

Kikuchi et al.

[11] Patent Number: 4,799,743

[45] Date of Patent: Jan. 24, 1989

[54] KITCHEN UNIT FOR PHYSICALLY HANDICAPPED PERSONS

[75] Inventors: Nobuaki Kikuchi, Hirakata; Hirohisa Fukuyama, Fukae-minamimachi; Tamio Hirabayashi, Hirakata; Kouichi Imai, 8-15, Shimeien, Ibaraki-shi, Osaka, all of Japan

[73] Assignees: Kouichi Imai; Matsushita Electric Works, Limited, both of Osaka, Japan

[21] Appl. No.: 44,620

[22] Filed: May 1, 1987

[30] Foreign Application Priority Data

Nov. 10, 1986 [JP] Japan ..... 61-267148

[51] Int. Cl.[4] ..... A47B 77/06

[52] U.S. Cl. ..... 312/228; 312/195; 312/196; 312/236; 312/309

[58] Field of Search ..... 312/228, 236, 194, 196, 312/239, 195, 209, 210, 138 A, 140, 309

[56] References Cited

U.S. PATENT DOCUMENTS

| | | | |
|---|---|---|---|
| 2,037,919 | 4/1936 | Foe | 312/194 |
| 3,715,972 | 2/1973 | Kelso et al. | 312/239 X |
| 3,915,529 | 10/1975 | Bernier | 312/236 X |
| 3,960,420 | 6/1976 | Speraw et al. | 312/140.1 |
| 4,002,383 | 1/1977 | Holloway | 312/228 X |
| 4,053,193 | 10/1977 | Grover et al. | 312/209 |
| 4,249,785 | 2/1981 | Hapgood et al. | 312/228 X |

*Primary Examiner*—Joseph Falk
*Attorney, Agent, or Firm*—Armstrong, Nikaido Marmelstein & Kubovcik

[57] ABSTRACT

In a kitchen unit specifically designed for use by physically handicapped persons sitting in a wheelchair, a pair of base cabinets mounted under a countertop are laterally spaced to define therebetween a wheelchair space opened forward and downward for allowing rolling entry of the wheelchair. With the kitchen unit thus configured, the physically handicapped person can use the kitchen unit satisfactorily and comfortably with the wheelchair extending into the wheelchair space under the countertop. Preferably, the kitchen unit includes an armrest table slidably mounted in one of the base cabinets adjacent the wheelchair space to provide a support or aid for the handicapped person during the kitchen work. A sink and surface cooking elements are located on the end portions of the countertop so as to leave therebetween a center cooking work surface while ensuring facilitated use thereof. The cooking elements are arranged in consideration of human engineering to assure comfortable handling of the cooking elements by the handicapped persons in the wheelchair. An auxiliary cabinet may be selectivly used for closure of the wheelchair space when the unit is utilized by non-handicapped persons.

1 Claim, 7 Drawing Sheets

KITCHEN UNIT FOR PHYSICALLY HANDICAPPED PERSONS

BACKGROUND OF THE INVENTION

1. Field of the Invention

The present invention relates in general to a kitchen unit, and more particularly to a kitchen unit designed for providing facilitated use by physically handicapped persons.

2. Description of the Prior Art

With promotion of social welfare, there is a growing demand to remodel the conventional kitchen units so as to be better suited for use by physically handicapped persons. In a practical scene, any conventional kitchen unit has a front wall perpendicularly extending downward from the front edge of the countertop thereof carrying a sink or surface cooking elements. The front wall, which usually takes the form of the door of a cabinet for storing kitchen utensils, indeed poses no problem as long as for use by physically non-handicapped persons. However, it acts as an obstacle for a physically handicapped person who manages himself or herself to do kitchen work on the countertop sitting in a wheelchair. Precisely, when the physically handicapped person tries to make an access to the kitchen unit sitting in the wheelchair for the kitchen work, the foremost portion of the wheelchair such as the footplates impede his or her access against the front wall of the kitchen unit, thereby holding the person still far apart from the countertop. Due to this inconvenience, the physically handicapped person who has limited elbowroom in the wheelchair suffers much difficulty in reaching the sink or surface cooking elements on the countertop during the kitchen work even when he or she fully extends the arms. Further, when the handicapped persons are required to reach the farthest portion on the countertop, the physically handicapped person is required to lift his or her waist or take unnatural and laborious postures and actions, which is not acceptable for most of the handicapped persons in the wheelchairs.

SUMMARY OF THE INVENTION

The present invention eliminates the above-mentioned inconvenience of the conventional kitchen unit for physically handicapped persons, and provides an improved kitchen unit better suited for use by such persons as well as by non-handicapped persons. A kitchen unit in accordance with the present invention comprises a pair of base cabinets to be mounted on the floor of a room, a countertop extending horizontally across the top of the base cabinets and carrying a sink and surface cooking elements. The base cabinets are laterally spaced apart to define therebetween a space below the countertop for receiving a wheelchair. The space has its bottom and front respectively opened downward and forward so as to permit therein rolling entry of the wheelchair. With the kitchen unit thus configured, the physically handicapped person in the wheelchair can make easy access to the countertop with the forefront portion of the wheelchair properly extended in the space.

Accordingly, it is a primary object of the present invention to provide a kitchen unit capable of being conveniently used by physically handicapped persons in wheelchairs as well as by non-handicapped persons.

The space for the wheelchair can be alternatively used to receive an auxiliary cabinet for storing kitchen utensils. With this scheme, the space can be efficiently utilized to provide an additional storage capacity in case that the kitchen unit is used by non-handicapped persons.

Therefore, it is another object of the present invention to provide a kitchen unit which can be readily adapted for use by non-handicapped persons.

In a preferred form, at least one of the base cabinets adjacent the wheel chair receiving space is provided with a drawer-like armrest table. The armrest table slidingly drawn out of the base cabinet for use as a comfortable support by the physically handicapped person during the kitchen work when he or she feels sick or tiresome. When not in use, the armrest table can be drawn back inside the base cabinet.

Therefore, it is another object of the present invention to provide a kitchen unit with an armrest table facilitating the kitchen work by the handicapped persons.

Preferably, the countertop has at least two surface cooking elements at its one end and a sink at the other end to define therebetween a cooking work surface which is located above the space for receiving the wheelchair. The two cooking surface elements are arranged in such a staggered relation that one surface cooking element remote from the cooking work surface is closer to the front end of the countertop than the other surface cooking element adjacent the work surface. With this configuration, the two surface cooking elements are arranged substantially on a circle having its center at the handicapped person sitting in front of the kitchen unit, or disposed substantially at the same distance from the handicapped person doing the kitchen work so that they can be reached within the arm of the handicapped person, facilitating the use of the surface cooking elements.

Therefore, it is a further object of the present invention to provide a kitchen unit which has a unique and convenient arrangement of the surface cooking elements for the kitchen work by the handicapped person in the wheelchair in contemplation of human engineering.

The auxiliary cabinet is preferably composed of a bottom plate and a front door frame upstanding from the front edge of the bottom plate so as to have an L-shaped configuration. When such an auxiliary cabinet is selected to be received in the space, an increased amount of storing capacity can be obtained because the auxiliary cabinet has no superfluous top, side and back boards. The rear surface of the bottom plate is preferably provided with a set of casters for rolling movement of the auxiliary cabinet on the floor into and out of the space for a wheelchair, which makes the auxiliary cabinet to be available as a wagon servicing foods or the like thereon. The front door frame is provided with a pair of hinged doors for closing the front of the space and for easy access to the interior thereof.

Therefore, it is further object of the present invention to provide a kitchen unit which has an auxiliary cabinet of maximum availability.

The above and other objects of the present invention can be appreciated more from the following detailed description in

DETAILED DESCRIPTION OF THE PREFERRED EMBODIMENT

Figure 1:
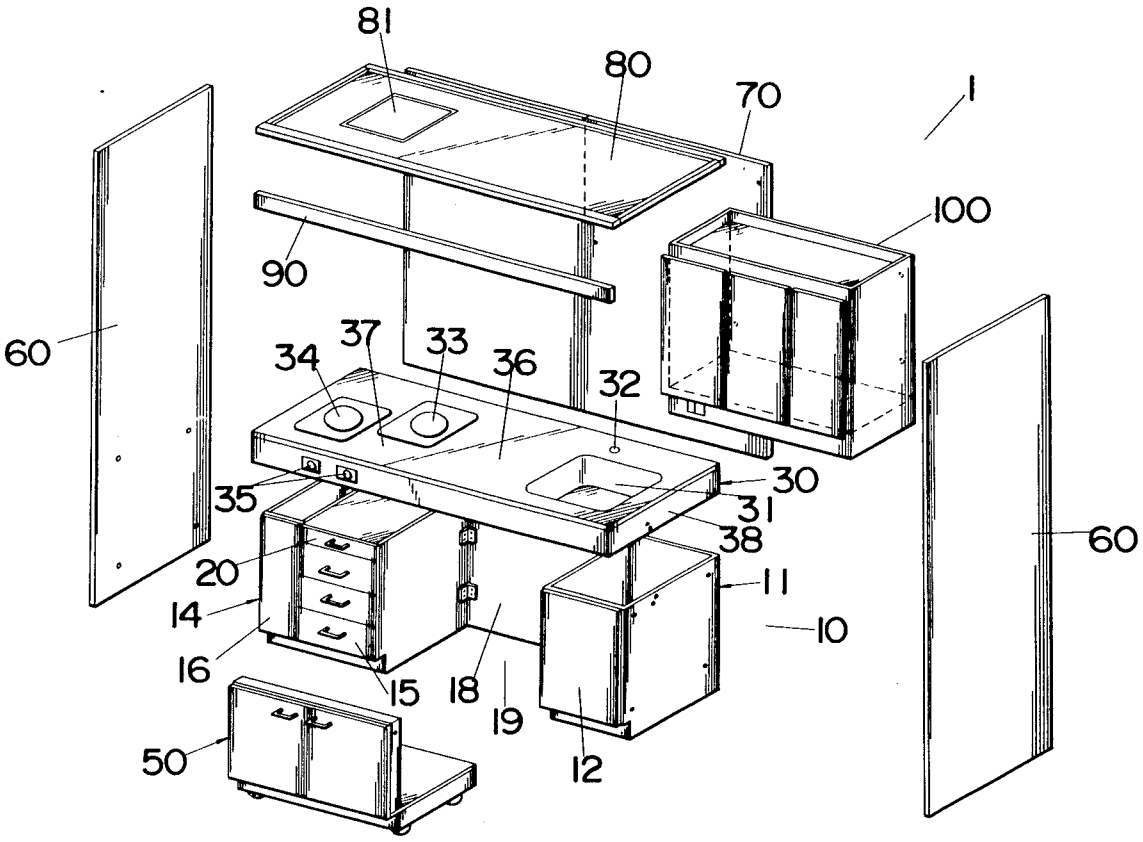
FIG. 1 is an exploded perspective view of a kitchen unit in accordance with a preferred embodiment of the present invention.

Referring firstly to FIG. 1, the kitchen unit 1 in accordance with the present invention includes a lower module 10 to be installed on a kitchen floor, and a countertop 30 fixed on top of the lower module 10 by means of clasps and screws. The side and back surfaces of the lower module 10 are covered respectively with a pair of side wall boards 60 and a back wall board 70 fastened thereto by means of screws. The uppermost edges of the side wall boards 60 and the back wall board 70 receive a ceiling board 80 of which front edge is provided with a reinforcing lumber 90. The space defined by the side wall boards 60, the back wall board 70 and the ceiling board 80 above the countertop 30 is equipped with a wall cabinet 100 fastened onto the back wall board 70 by means of screws.

Figure 7:
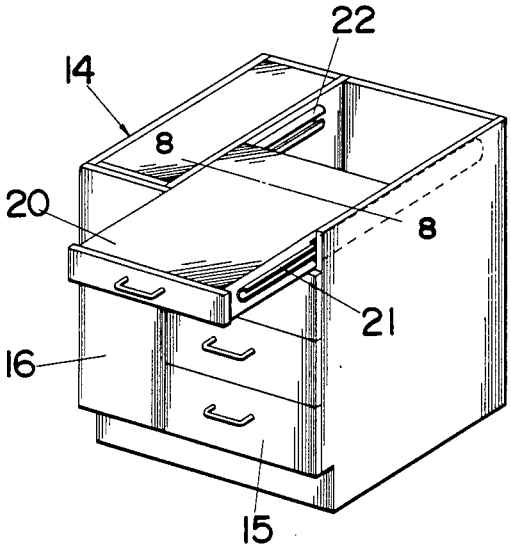
FIG. 7 is a perspective view of an armrest table slidably mounted in one of base cabinets.
Figure 8:
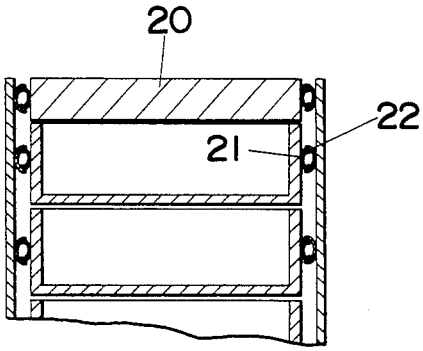
FIG. 8 is a sectional view taken along the line 8—8 of FIG. 7.

The lower module 10 is composed of right and left base cabinets 11 and 14 and a back board 18, and constructed such that the base cabinets 11 and 14 are laterally spaced to define therebetween a space 19 opened forwardly and downwardly for permitting the entry of a wheelchair W, thus permitting the use of the lower module 10 by a handicapped person M in the wheelchair W extending into the space 19. The base cabinets 11 ad 14 are secured to the backboard 18 by means of clasps and screws to be joined to each other through the backboard 18. The right base cabinet 11 has an internal space with a hinged front door 12 for storing kitchen utensils and so forth. Provided in the left base cabinet 14 are drawers 15 and a compartment with a front door 16, each defining therein storage spaces for kitchen utensils and the like with the drawers 15 in adjacent relation to the space 19. Also, the left base cabinet 14 includes at its top a drawer type armrest 20 in the form of a flat table which is slidably supported for horizontal movement between a position within the base cabinet 14 and a position in front of the cabinet 14 of FIG. 7, where it serves as an armrest for receiving the arms of the person doing kitchen works sitting in the wheelchair. With the provision of the armrest 20 on the base cabinet 14 adjacent the wheelchair receiving space 19, the physically handicapped person can readily make the use of it when he or she feels sick or tiresome during the kitchen work. Either side of the armrest 20 is provided with sliders 21 slidably engaged within guide rails 22 with sufficient bearing strength for supporting the weight of the user. Stopper means (not shown) is provided to prevent the armrest 20 from being completely drawn out of the left base cabinet component 14. It is noted here that the armrest 20 can be provided either in the right base cabinet 11 or the left cabinet component 14. The armrest 20 can also serve as a normal table for providing another work surface for the kitchen work.

Figure 2:
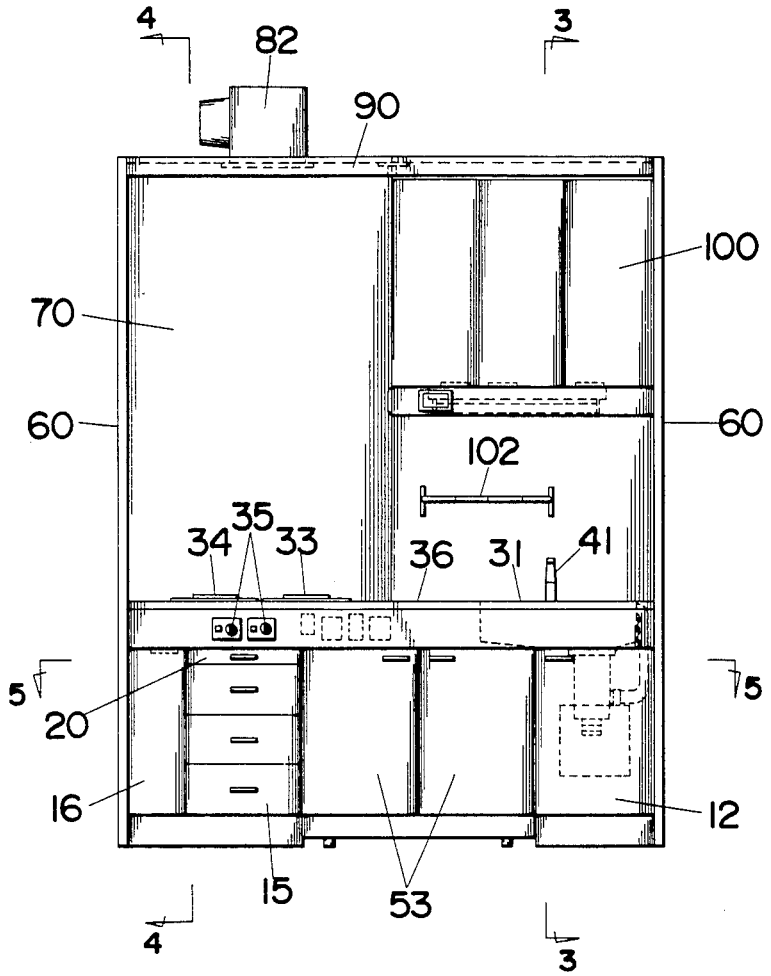
FIG. 2 is a front view of the kitchen unit of FIG. 1.
Figure 3:
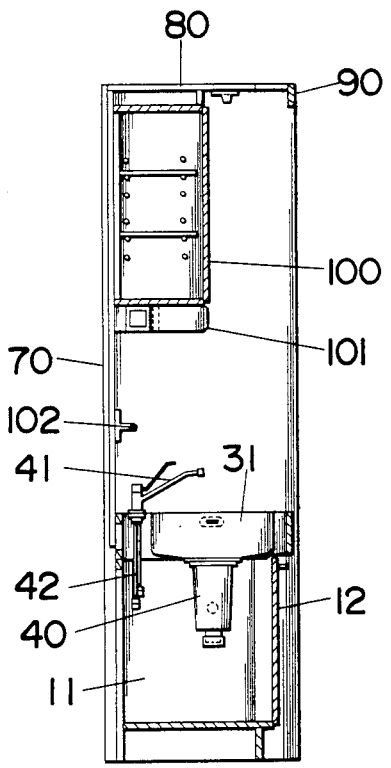
FIG. 3 is a sectional view taken along the line 3—3 of FIG. 1.
Figure 5:
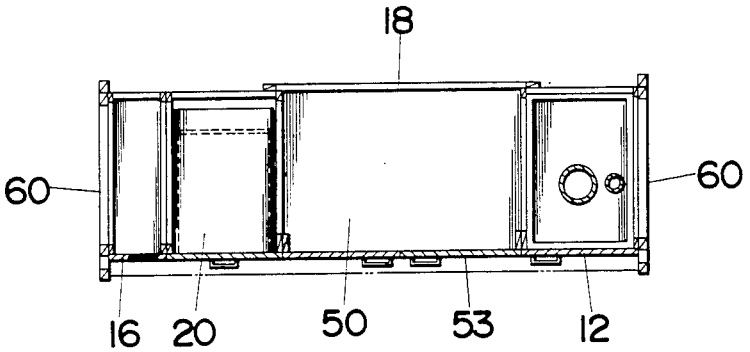
FIG. 5 is a sectional view taken along the line 5—5 of FIG. 1.
Figure 9:
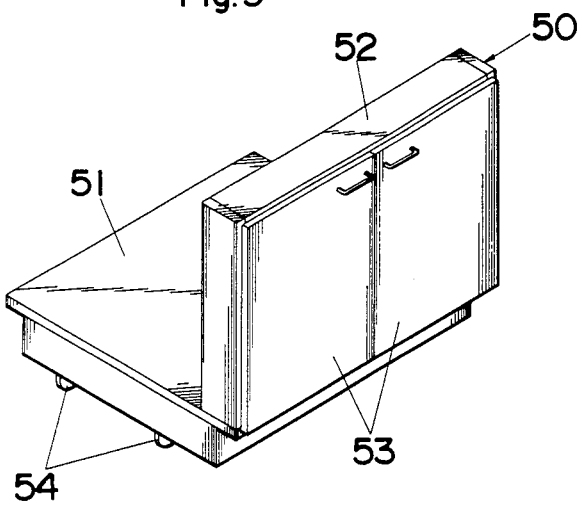
FIG. 9 is a perspective view of an L-shaped auxiliary cabinet.
Figure 10:
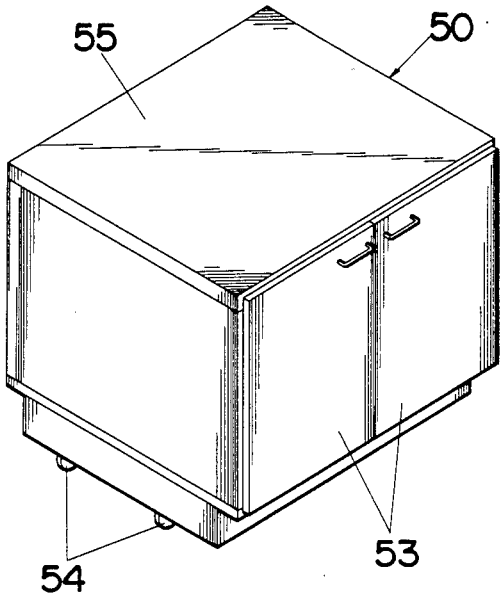
FIG. 10 is a perspective view of a box type auxiliary cabinet.

When the kitchen unit is intended to be used by non-handicapped persons, the space 19 formed between the right and left base cabinets 11 and 14 can be used for receiving an auxiliary cabinet 50 in an attempt to make more efficient use thereof. With the addition of the auxiliary cabinet 50, the total storage capacity of the kitchen unit can be increased. An example of the auxiliary cabinet 50 is shown in FIG. 9, where the cabinet 50 consists of a bottom plate 51 and a front frame 52 upstanding from the front edge of the bottom plate 51 to have an L-shaped configuration. The front edge of the front frame 52 is provided with a pair of hinged doors 53, while the bottom plate 51 is provided with a set of rollers 54 for increased mobility into and out of the space 19. Another example of the auxiliary cabinet 50 is shown in FIG. 10 to be of a box-like configuration with a cubic body 55 and a pair of hinged front doors 53. The bottom of the body 55 is likewise provided with a set of rollers 54 as in the L-shaped top open cabinet 50 of FIG. 9. Either type of the auxiliary cabinets 50 may be fastened to the inside walls of the cabinets 11 and 14 by means of screws as shown in FIGS. 2 and 5.

The countertop 30 has a sink 31 and a pair of surface cooking elements 33 and 34, the sink 31 being formed on the right end of the countertop 30 and the surface cooking elements 33 and 34 on the left end thereof so as to leave therebetween a cooking work surface 36. The countertop 30 is covered along its periphery with face panels 38, where the lowest edge of the front panel 38 is chamfered for safe access to the countertop 30 by the physically handicapped persons in the wheelchair W. The sink 31 is designed to have a reduced depth of about 150 mm for facilitating the access by the hands of the person in the wheelchair W. The reduction in the depth of the sink 31 is intended to compensate for the displacement of the sink 31 to the right and to render the distance between the person M in the wheelchair W and the bottom of the sink substantially at the same value as measured in the case where the conventional sink of increased depth would be located in the center of the countertop. Further, the incorporation of the sink 31 of reduced depth is advantageous in preventing the lowest end of the sink 31 from protruding into the space 19, ensuring as much as free space below the countertop 30 for facilitating the entry of the person M in the wheelchair W into the space 19. A faucet 41 to be provided through a hole 32 in the countertop 30 adjacent the sink 31 is designed to spurt water in a foam-making style to prevent possible splashing of the water out of the sink attributable to the reduced depth of the sink 31. With the sink 31 thus configured, there is achieved no protrusion of the sink 31 into the space 19 allowing safe and comfort entry of the legs of the physically handicapped person M sitting in the wheelchair W. The sink 31 is connected to a drain trap 40, while the faucet 41 is connected to a water supply pipe 42 to provide water in the sink 31. The drain trap 40 and the water supply pipe 42 are both enclosed inside the right base cabinet 11 so as not to cause any protrusion in the space 19.

Figure 4:
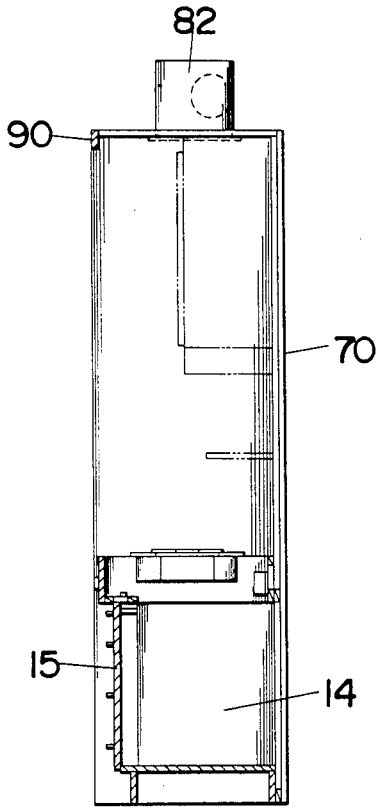
FIG. 4 is a sectional view taken along the line 4—4 of FIG. 1.
Figure 6:
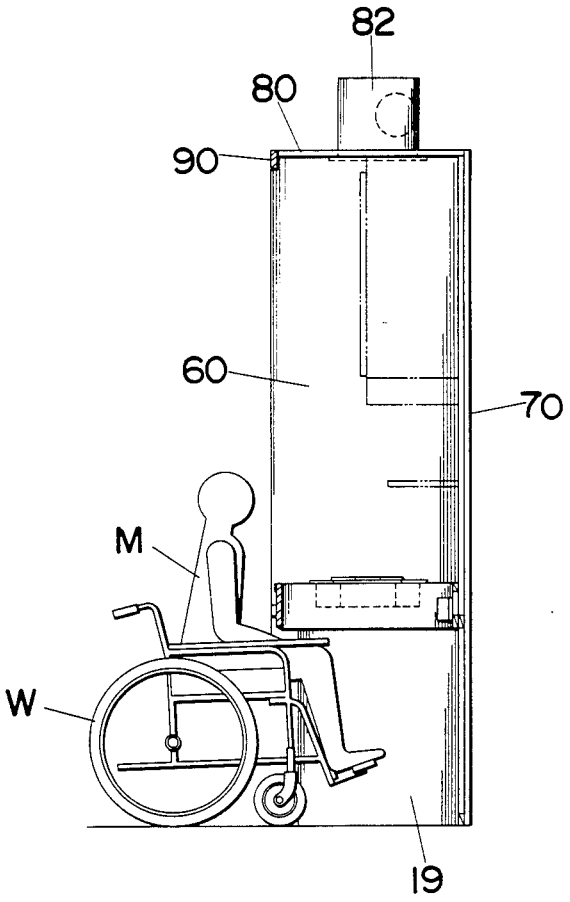
FIG. 6 is a schematic side view illustrating the position of the physically handicapped person in a wheelchair ready for doing kitchen work.
Figure 11:
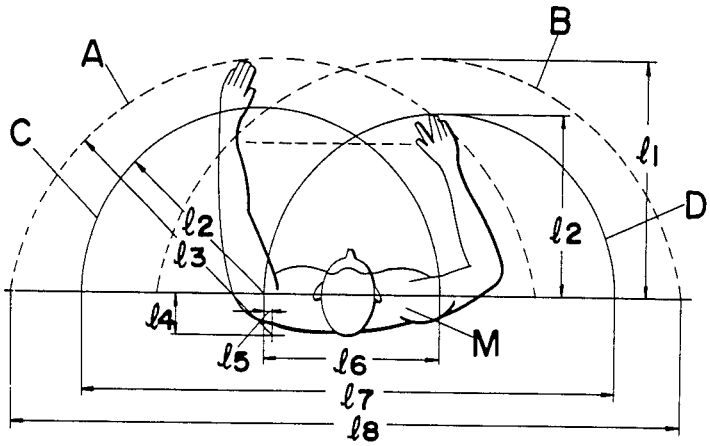
FIG. 11 is a schematic view for illustrating the moving range of the arms of a physically handicapped person in front of the kitchen unit.
Figure 12:
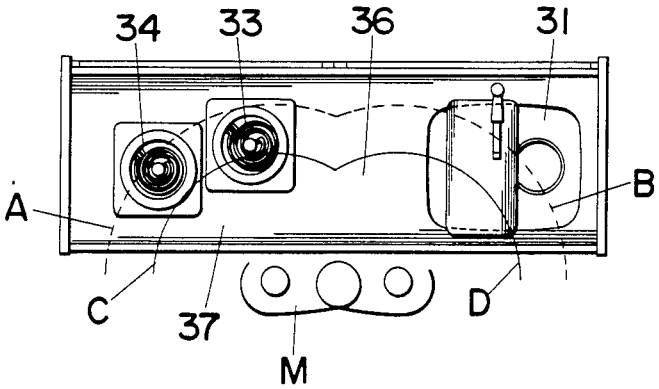
FIG. 12 is a schematic illustration of the countertop with the moving range of FIG. 9 being superposed thereon.

The surface cooking elements 33 and 34 are controllable by means of control knobs 35 provided in the front panel of the face panel 38 and arranged on the countertop 30 in such a staggered relation that the surface cooking element 33 located closer to the cooking work surface 36 is displaced rearwardly, while the other surface cooking element 34 located remote from the cooking work surface 36 is displaced forwardly, as shown in FIGS. 4 and 12. This is a most effective measure for comfortable cooking work by the handicapped person in the wheelchair W and is achieved through a human engineering approach, which will be discussed below. When the physically handicapped person M in the wheelchair W takes a posture of FIG. 6, the person M can move his hands within a limited range, as illustrated in FIG. 11. In FIG. 11, length $L_1$, $L_2$, $L_3$, $L_4$, $L_5$, $L_6$, $L_7$ and $L_8$ are respectively assumed to be at 20 in, 15.5 in., 23.5 in., 3.5 in., 2 in., 16 in., 47 in. and 59 in. Postulating that the person M has his maximum reach $L_1$, the tips of the person's hands trace the circular paths A and B. In the meanwhile, the person M has his hand movement along the circular paths C and D without difficulty or discomfort during the kitchen works. When the circular paths A, B, C and D are interposed on the countertop as illustrated in FIG. 12, it can be understood that the sink 31 and the surface cooking elements 33 and 34 are disposed as far as possible from the physically handicapped person M while ensuring satisfactory handling. Accordingly, this arrangement of the sink 31 and the surface cooking elements 33 and 34 based upon the human engineering concept provides a broader cooking work surface 36 on the countertop 30 in front of the person M, while ensuring convenient and easy cooking operation.

The ceiling board 80 has a rectangularly shaped hole 81 above which is provided with a ventilation hood 82 enclosing an electric exhaust fan for expelling smokes or the like produced through the process of cooking with the surface cooking elements 33 and 34. The wall cabinet 100 is installed to the upper right portion of the back wall board 70 at a variable height position depending on the particular requirement of the user. Practically, the height of the wall cabinet 100 may be lowered for use by a physically handicapped person in the wheelchair, or elevated when used by non-handicapped persons. The wall cabinet 100 has its lowest surface provided with an illumination apparatus 101 as shown in FIG. 2 for providing illumination on the cooking work surface. Attached on the back wall board 70 below the wall cabinet is a hanger 102 for hanging dishcloths and the like.

It is noteworthy that the above-mentioned kitchen unit is fabricated parts by parts for on-site assembly in a kitchen room where they are integrally secured into a complete kitchen unit.

What is claimed is:

1. A kitchen unit comprising:

a pair of base cabinets for fixedly mounting on the floor of a room;

a countertop extending horizontally across the top of the base cabinets and having mounted therein, adjacent one of its ends, a sink and, adjacent its other end, at least two surface cooking elements with a cooking workspace on said countertop therebetween;

said base cabinets being arranged in laterally spaced relation and defining therebetween a frontally accessible wheelchair space below said countertop and said cooking workspace thereon, said wheelchair space having its bottom opened to the floor so as to permit entry therein of a wheelchair and the use of the kitchen unit by a physically handicapped person in the wheelchair, said cooking elements being mounted in said countertop in a staggered relation with the surface cooking element located closest to the cooking workspace displaced rearward of the countertop and the surface cooking element located remotest from the workspace displaced forward of the countertop, and an auxiliary cabinet removably received in said wheelchair space for use of the kitchen system by non-handicapped persons, sad auxiliary cabinet being an L-shaped structure with a bottom plate and a front door frame upstanding from the front edge of the bottom plate, said bottom plate being provided with a set of rollers for rolling movement of the auxiliary cabinet on the floor into and out of said wheelchair space, and said front door frame being provided with a pair of hinged doors for closing the front of the wheel chair space and for providing access to the interior thereof when the auxiliary cabinet is selected in use to occupy the wheelchair opening.

* * * * *